United States Patent [19]

Burch et al.

[11] Patent Number: 4,788,388

[45] Date of Patent: Nov. 29, 1988

[54] SNAP ACTING SWITCHES

[75] Inventors: Lyndon W. Burch, Boston, Mass.; Hadley K. Burch, Pittsfield, Vt.

[73] Assignee: B/K Patent Development, Inc., Los Angeles, Calif.

[21] Appl. No.: 922,283

[22] Filed: Oct. 23, 1986

Related U.S. Application Data

[63] Continuation-in-part of Ser. No. 759,412, Jul. 26, 1985, abandoned.

[51] Int. Cl.[4] ..... H01H 13/38

[52] U.S. Cl. ..... 200/77; 200/68.1; 200/277; 200/283

[58] Field of Search ..... 200/77, 277, 68.1, DIG. 28, 200/276, 329, 283

[56] References Cited

U.S. PATENT DOCUMENTS

| | | | |
|---|---|---|---|
| 985,421 | 2/1911 | Klein | 200/77 |
| 1,182,087 | 5/1916 | Hart | 200/77 |
| 1,194,243 | 8/1916 | Schultze | 200/77 |
| 1,257,613 | 2/1918 | Kocourek | 417/417 |
| 1,284,367 | 11/1918 | Klein | 200/77 |
| 1,878,255 | 9/1932 | Wolfe | 200/51.16 |
| 2,466,970 | 4/1949 | Schellman | 200/77 |
| 2,633,510 | 3/1953 | Schellman | 200/77 |
| 2,748,215 | 5/1956 | Davis | 200/67 |
| 2,831,093 | 4/1958 | Trussell | 200/160 |
| 2,969,443 | 1/1961 | Barden et al. | 200/77 |
| 3,274,355 | 9/1966 | Francy | 200/77 |
| 3,600,533 | 8/1971 | English | 200/77 |
| 3,632,937 | 1/1972 | Nanninga | 200/160 |
| 3,681,547 | 8/1972 | Burch et al. | 200/77 |
| 4,027,122 | 5/1977 | Bevacqua | 200/77 |
| 4,061,895 | 12/1977 | Hults | 200/157 |
| 4,154,996 | 5/1979 | Arnold | 200/77 |

FOREIGN PATENT DOCUMENTS

| | | |
|---|---|---|
| 232939 | 3/1925 | United Kingdom . |
| 730460 | 12/1953 | United Kingdom . |
| 2033677A | 9/1979 | United Kingdom . |

*Primary Examiner*—Renee S. Luebke

*Attorney, Agent, or Firm*—Lahive & Cockfield

[57] ABSTRACT

A snap acting switch comprising an elongate cantilever mounted spring member having a contact portion, an electrically conductive element upon which the contact portion bears, and an actuator having surfaces intersecting at an angle, one of the surfaces bearing on the spring member. The switch is actuated by causing the spring member to approach and pass over the intersection of the surfaces, which causes the bearing pressure of the contact portion to increase before the snap action occurs.

12 Claims, 7 Drawing Sheets

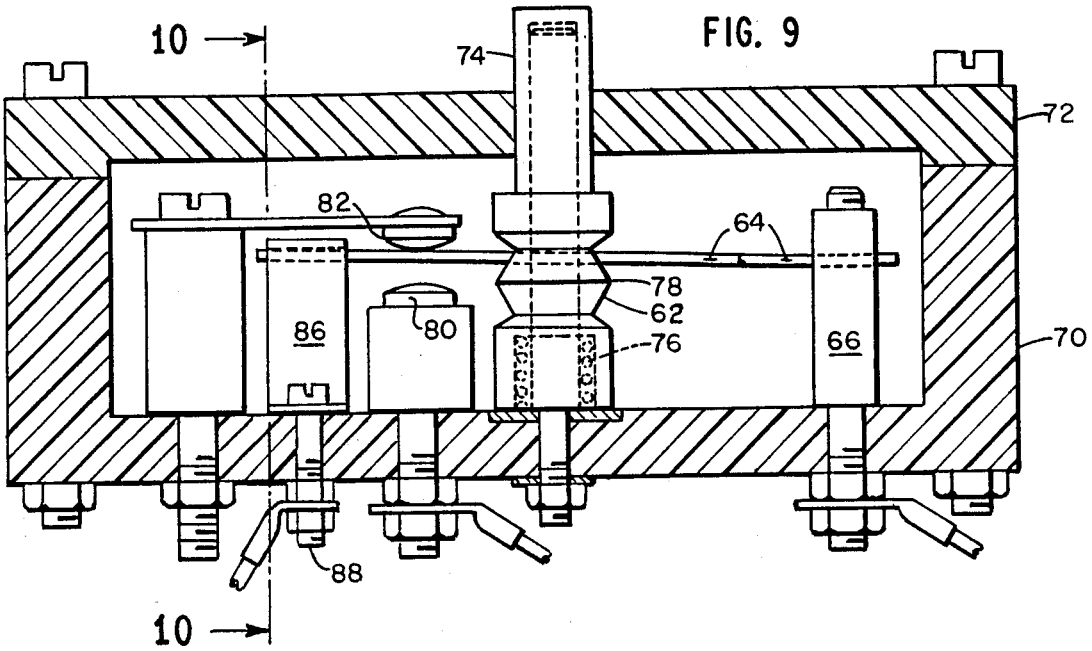
FIG. 9
FIG. 10
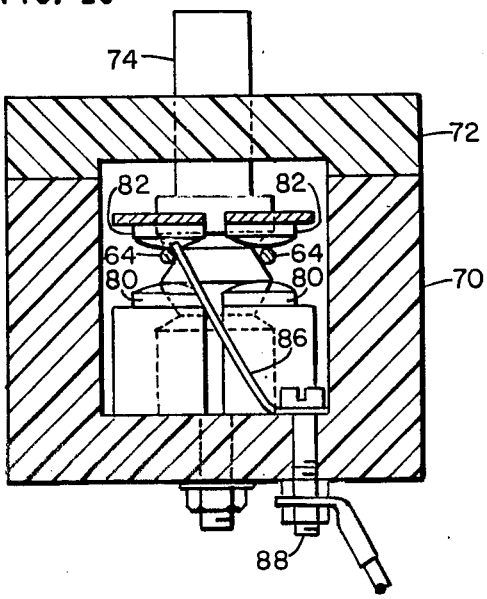
FIG. 11
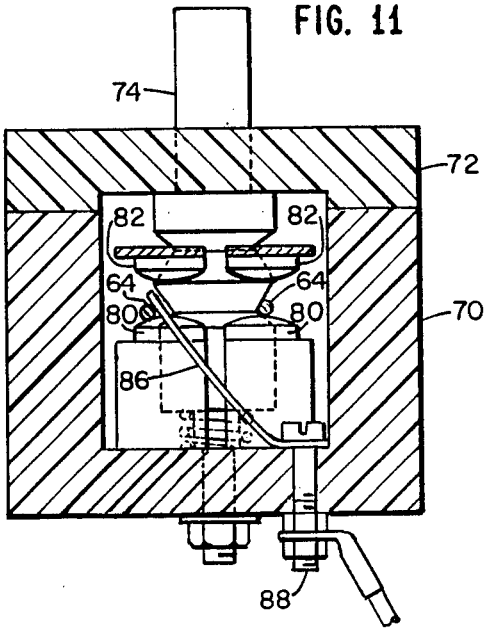

SNAP ACTING SWITCHES

CROSS REFERENCE TO RELATED APPLICATION

This application is a continuation-in-part of copending application Ser. No. 759,412, filed July 26, 1985, by Lyndon W. Burch, now abandoned.

SUMMARY OF THE INVENTION

This invention relates generally to snap-acting switches, and more particularly to switches having provision to maintain adequate contact pressure and current carrying capacity as they are activated toward the contact breaking or snap position.

In many snap-acting switches having a fixed contact and a contact movable toward or away from a fixed contact, the contact pressure force decreases continuously during a substantial portion of the motion of the actuator as the actuator approaches the snap position at which the contacts separate. The loss of contact pressure before the snap action occurs is undesirable because it results in an increase in contact resistance, affecting the flow of electrical current. This may result in sparking, pitting of the contact surfaces, and reduction in the useful life of the switch. It is a principal object of this invention to provide an improved switch in which the contact pressure increases rather than decreases as the snap position is approached, whereby the current carrying capacity of the switch is maintained.

In some snap action switches parts of the structure are mounted as so-called floating elements, typically constrained for limited movement between alternate positions by adjacent parts. Thus the floating parts are not securely attached to the switch structure and reliance is placed on stops and resilient forces to ensure their correct positioning and function. Frequently, switches having such parts have malfunctioned by jamming, distortion or disclocation of the parts, or by hang-ups. A second object of this invention is to provide snap acting switches that do not rely on the use of floating parts.

A third object of the invention is to provide switches in which the movable contact translates over the surface of the contact which it engages as the actuator approaches the snap position. This translation provides a useful wiping or rolling engagement between the contacts, further improving their current carrying capacity. Such translational movement is desirable not only between the movable contact and a contact from which it breaks by the snap action, but also between the movable contact and a contact which it engages by the snap action, the translational movement in the latter case preferably following the snap action for a brief period.

A fourth object of the invention is to provide snap action structures adaptable for a variety of applications including single and double throw, single and double pole, normally open, normally closed and manually reset forms in various combinations, as well as mechanically, thermostatically, and pressure actuated forms including circuit breakers.

A fifth object of the invention is to provide snap action switches that may be manufactured inexpensively but with precise adherence to performance specifications.

With the foregoing and other objects hereinafter appearing in view, this invention features the use of an elongate spring member that is cantilever mounted at one end on a support. At one end this member is deflectable in mutually perpendicular directions normal to its length. An actuator having surfaces intersecting at an angle is provided, with one of these surfaces engaging the spring member, deflecting it and causing a contact portion thereon to engage a second conductive element. The actuator is movable relative to the latter element to cause the engagement position to approach the intersection of the surfaces. When the engagement position passes over this intersection the force applied by the actuator to the spring member is interrupted and the contact portion is thereby caused to snap away from the conductive element.

The foregoing structure can be achieved in a large variety of switch configurations, including all of the types previously noted. In all of these forms the contact portion may be adapted to move over the conductive element with a contact pressure thereon that increases throughout all or a major part of the actuator movement prior to reaching the snap position, and such movement may produce either a wiping or a rolling engagement of the contacts as desired.

For example, the elongate spring member may be a part separate from the actuator, or it may be fabricated with the actuator from a single piece of wire or sheet stock. Its contact portion may be an integral part, or may be a sleeve or sheet strip affixed to the spring member, or a roller mounted on the spring member. The electrically conductive element, such as the front or back contact of the switch, may be fixed to the support or may be resiliently mounted on the support, and the resilient mounting of the element may or may not be the means for producing the movement relative to the actuator which causes the snap action. The actuator may comprise plural parts such as a leaf or plate formed with intersecting surfaces and resiliently mounted on the support and a pushbutton, thumb screw or other suitable part for moving it; or the actuator may comprise a single piece such as a pushbutton or formed wire with the intersecting surfaces forming an integral part.

Switches constructed according to this invention do not require certain of the component parts used in conventional snap action switches, such as previously deformed pieces of spring metal, coil springs, magnetic holders or spring metal parts that are deformed by tension or compression in assembling the switch.

Other features of the invention will be appreciated from the following description of illustrative embodiments.

DESCRIPTION OF THE DRAWING

FIGS. 9 to 11 illustrate a third embodiment which is a variant of the second embodiment operable as a manually reset circuit breaker, FIG. 9 being a side elevation and FIGS. 10 and 11 being elevations in section taken on line 10—10 of FIG. 9 showing the parts in positions before and after the circuit breaker action, respectively.

DETAILED DESCRIPTION

Figure 1:
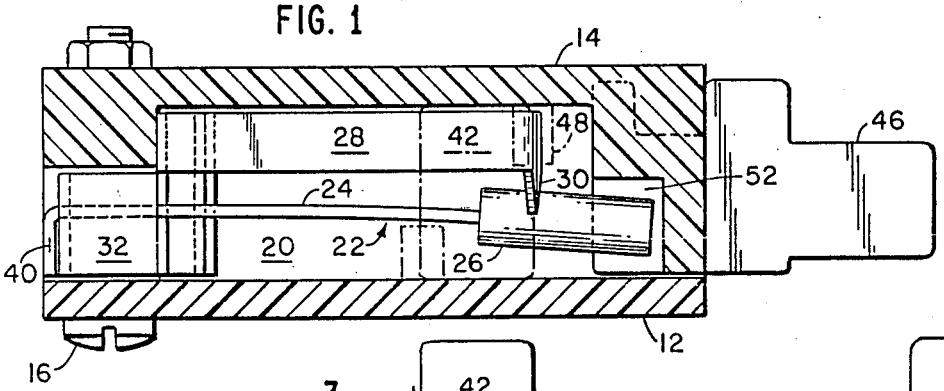
FIGS. 1 to 5 illustrate a first, single pole, double throw push button embodiment, FIG. 1 being a plan view in section, FIGS. 2 and 4 being side elevations respectively showing the switch with the button undepressed and depressed, with the cover 12 removed, and FIGS. 3 and 5 being end elevations in section taken on lines 3—3 and 5—5 of FIGS. 2 and 4, respectively.

Referring to FIGS. 1 to 5, a first embodiment comprises a body of insulating material including parts 12 and 14 fastened together by a pair of screws 16 and 18. These parts enclose a cavity 20 in which there is mounted a center contact means 22 comprising a cantilever mounted wire spring 24 and an electrically conductive sleeve 26 fixedly secured to the wire. The cavity also contains an actuator 28 formed of flat leaf spring material and including an elongate section terminating with a V-shaped portion 30 bent at right angles thereto. The actuator 28 has a number of folds, including a fold 32 received in a slot in the member 14, as well as folds 34 and 36 leading through another slot in the member 14 to a center contact terminal 38. The wire 24 extends into and through the fold 32 and through a hole in the fold to an end 40 which is bent over the fold as shown in FIG. 1. The metal of the fold is suitably formed over and around the wire to accommodate its thickness in a suitable manner (not shown).

A slot in the member 14 receives a push button 42 of insulating material which bears upon the actuator 28.

A pair of fixed alternate front and back contacts 44 and 46 extend through slots in the body 14 and comprise a pair of abutments having fixedly spaced apart surfaces extending in a direction perpendicular to the direction of extent of the wire 24.

Figure 2:
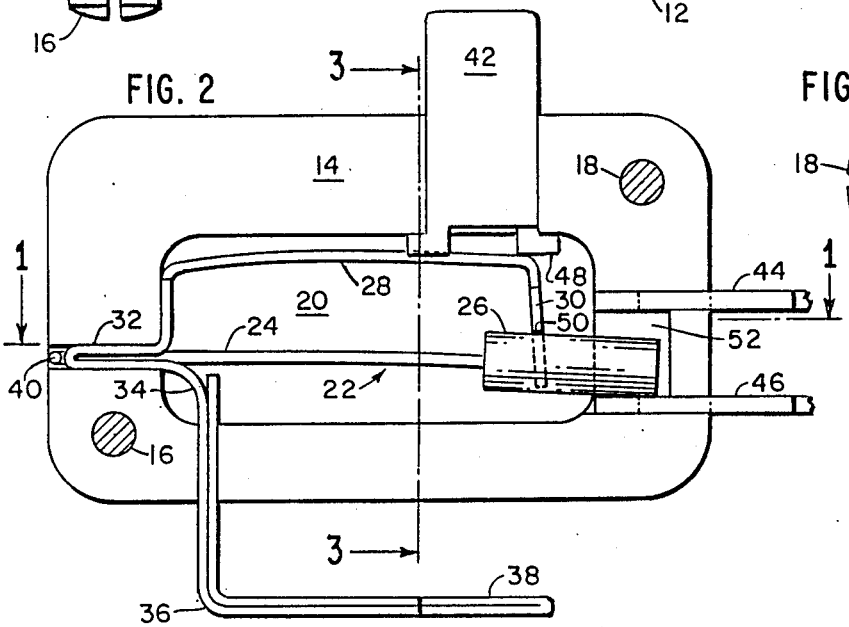
Figure 3:
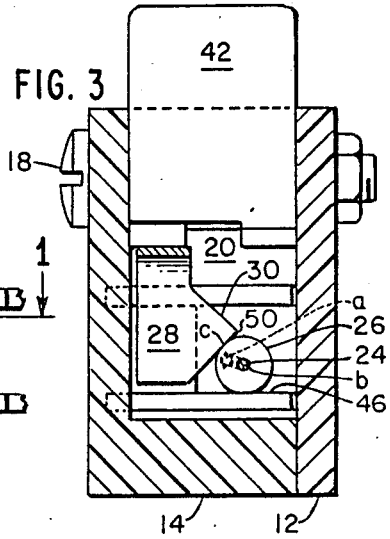

FIGS. 2 and 3 illustrate the switch when it is in the position with no external force applied to the push button 42. The actuator 28, being of spring material biased in an upward direction, bears on a shoulder 48 of the push button, raising it to the position shown. In this position the V-shaped portion 30 is located so that it bears on the electrically conductive sleeve 26 which in turn bears on a surface of the normally closed contact 46 within an aperture 52 formed in the member 14. The axis of the wire 24 is deflected from a position "a" which it would take if the actuator were removed. (See FIG. 3.) The direction in which the wire 24 is deflected is displaced from the line between the deflected axis "b" (FIG. 3) and the point of contact "c" between the sleeve 26 and the portion 30 which results in an appreciable contact force being developed between the sleeve and the contact 46.

When the push button 42 is depressed an incremental distance, the V-shaped portion moves downwardly as viewed in FIG. 3, deflecting the wire 24 toward the right by a proportional distance depending on the slope of the contacting surface of the portion 30. This results in a wiping contact as well as an increase in the contact force between the sleeve 26 and the contact 46. As the push button is further depressed this contact force is further increased, with the deflection of the wire continuing to increase proportionally to the movement of the pushbutton, until the point "c" reaches the intersection or apex 50 of the V-shaped portion 30. Further movement, although increasing the deflection, increases it at an increasingly slower rate as the sleeve begins to move over the apex, and the contact force between the sleeve 26 and the contact 46 begins to decrease as the point "c" approaches the line through the points "a" and "b." When the point "c" reaches this line the contact force between the sleeve 26 and the contact 46 is reduced to zero, and any additional movement of the push button causes the contacts to snap open.

Figure 4:
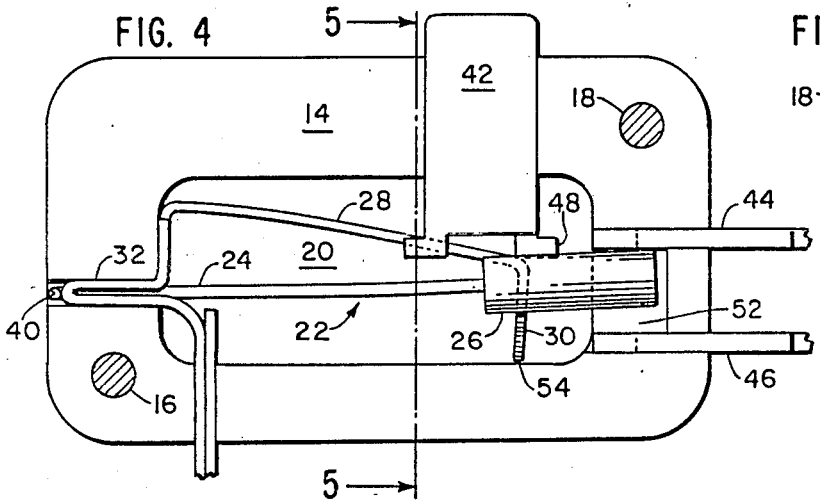
Figure 5:
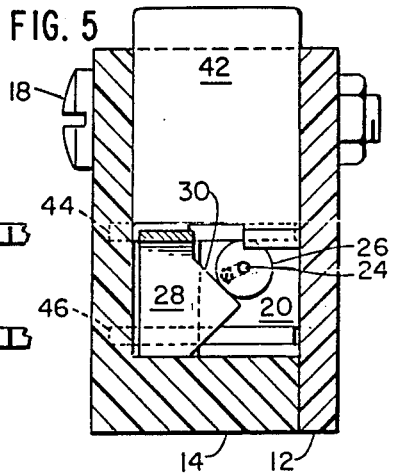

In the snap action movement the sleeve 26 is moved over the apex 50 and into immediate engagement with the normally open contact 44 by the restoring force of the spring 24, coming to rest in engagement with that contact and with a point on the other intersecting surface of the portion 30. Still further downward movement of the push button 42 may occur, causing a wiping action of the sleeve 26 on the contact terminal 44 until the actuator strikes the inner wall of the cavity 20 at 54 (FIG. 4).

If the push button 42 is progressively released, the parts move back toward the position shown in FIG. 2, with the bearing engagement position of the sleeve 26 on the V-shaped portion 30 progressing toward the apex 50, and at an intermediate position passing said apex and snapping back into contact with the terminal 46.

During most of the movement of the push button in either direction as described above, the contact force between the sleeve 26 and the contact 44 or 46 increases as the apex 50 moves toward the point of contact "c" between the V-shaped portion 30 and the sleeve. The portion of this movement during which the contact force decreases is relatively small and is a function of the diameter of the sleeve 26. In general, this portion of the movement is reduced if the diameter is reduced, and in practical embodiments it may be reduced sufficiently to become insignificant as compared with the much greater portion of the movement during which the contact pressure is increasing.

Figure 6:
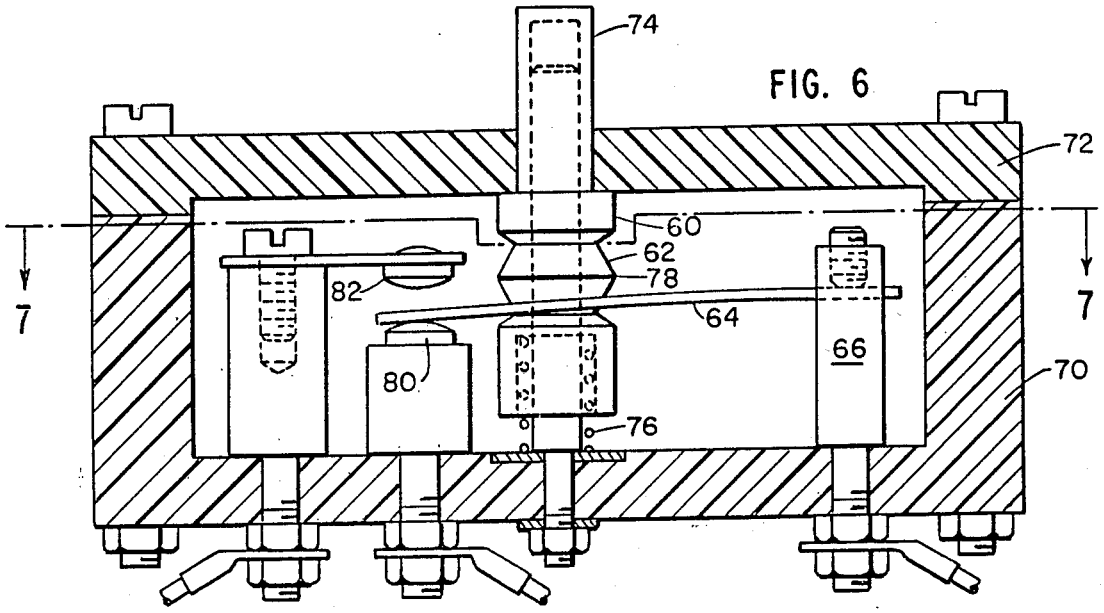
FIGS. 6 to 8 illustrate a second, double pole, double throw push button embodiment, FIGS. 6 and 8 illustrating the parts with the push button undepressed and depressed, respectively, and FIG. 7 being a plan view in section taken on line 7—7 of FIG. 6.
Figure 7:
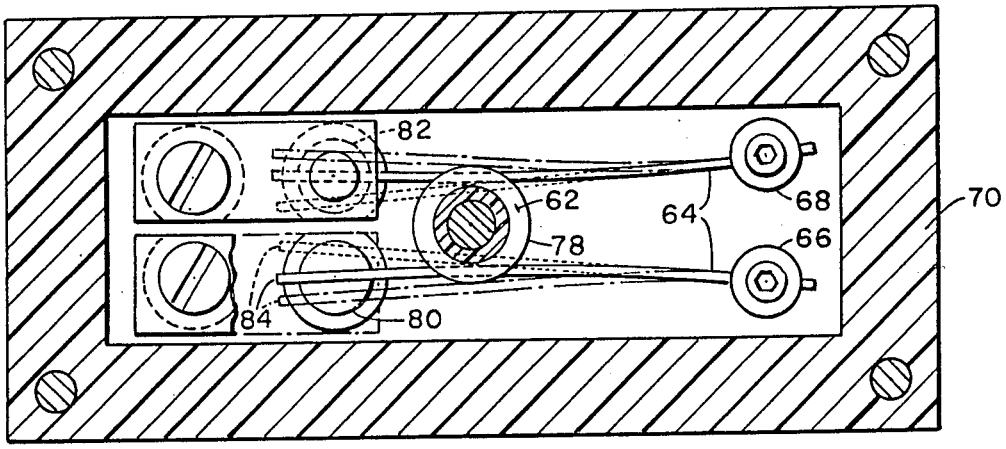
Figure 8:
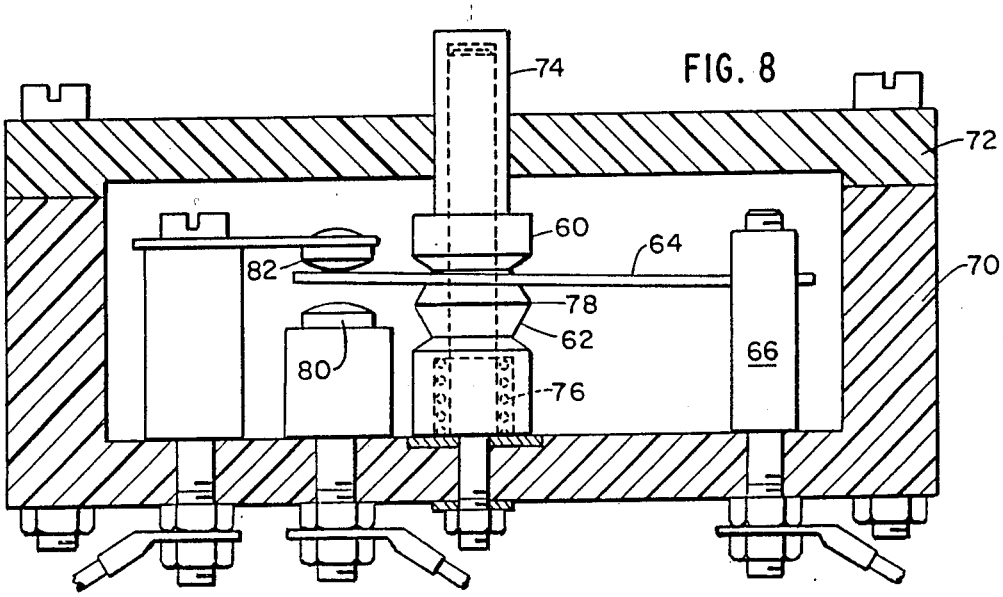

The embodiment of FIGS. 6, 7 and 8 illustrates a double pole form of the invention, in which the actuator comprises a spool 60 having an annular V-shaped portion 62 or solid of revolution which replaces the flat V-shaped portion 30 in the embodiment of FIGS. 1 to 5. This provides a pair of oppositely-directed V-shaped portions respectively having bearing engagement with a pair of spring wires 64. Each of these spring wires is cantilever mounted on a post 66 or 68 secured to a body comprising insulating parts 70 and 72. The spring wires 64 are preferably held in a variable deflected state by contact with the V-shaped portion 62 of the spool 60.

The spool 60 is formed of insulating material and has an integral push button 74 extending therefrom through an aperture in the part 72. A compression spring 76 urges the push button to the position shown in FIG. 6, in which position the apex 78 of the V-shaped portion 62 is located so that the wires 64 are snapped into engagement with fixed normally closed alternate contacts 80.

Opposing each of the contacts 80 are fixed normally open alternate contacts 82.

In operation, when the push button 74 is depressed, the V-shaped portion bears upon the spring wires 64 with increasing bearing engagement force, this force increasing as the position of engagement approaches the apex 78. At the same time, each of the wires 64 moves with a wiping action across one of the contacts 80, passing through a series of positions 84 (FIG. 7), moving with a contact pressure upon the contacts 80 which increases in the manner described with reference to FIGS. 1 to 5, as the bearing engagement position of the wires on the V-shaped portion 62 reaches the apex 78. The snap action movement causes the wires 64 to pass over the apex and to snap into contact with the contacts 82. Typically, when the wires 64 first engage the contacts 82 the portions thereof engaging the V-shaped portion 62 are in engagement with an intermediate position on the latter spaced from the apex 78, and further downward movement of the push button 74, as viewed in the drawing, causes the wires to slide over the portion 62 in the direction away from the apex 78, producing a wiping movement of the wires across the contacts 82 similar to the movement depicted at 84 in FIG. 7. FIG. 8 depicts the push button 74 in its limit position with the spool 60 abutting the inner wall of the part 70.

Upon the release of externally applied pressure to the push button 74, the parts return to the position of FIG. 6, producing the same forces upon and motions of the wires 64 previously described, with the wiping motion and increased contact pressure being applied to the contacts 82 prior to the snapping of the wires 64 back into contact with the contacts 80.

With respect to the embodiments of FIGS. 1 to 5 and 6 to 8, it will be apparent that the electrically conductive parts of the movable contact means that engage the fixed abutting alternate contact terminals 44 and 46 or 80 and 82 may have frictional contact therewith as illustrated, or the contact portions such as the sleeve 26 (FIG. 2) may be fitted with rollers for rolling engagement with these terminals. Likewise, the portions of the movable contact wires engaging the V-shaped portion of the actuator may have frictional contact therewith or may be fitted with rollers for rolling contact. Also, the spring wires shown in the drawings may be replaced, if desired, with helically wound elongate springs.

FIGS. 9 to 11 illustrate a variant of the embodiment of FIGS. 6 to 8, which is adapted to operate as a manually reset thermal overload switch. The embodiment shown is a double pole, double throw embodiment in which the parts common to those of FIGS. 6 to 8 have the same reference numerals and function as described above.

A bimetal strip 86 is mounted on the body 70 by a screw 88 and extends to a position engaging one of the spring wires 64 when the push button 74 is in the manually reset position shown in FIG. 10. When the parts are in this position, the spring wires 64 are deflected by the V-shaped actuator member 62, and their restoring forces on that member are sufficient to prevent the push button from moving upwardly under the force of the compression spring 76. This condition continues to apply while the temperature is below a predetermined value.

When the temperature of the bimetal strip 86 exceeds the last-mentioned temperature, it applies a force to a wire 64 in opposition to its restoring force and sufficient in magnitude to enable the force of the spring 76 to overcome that of the wires 64, elevating the push button 74 to the position shown in FIG. 11 and causing the switch to perform a snap action. The strip 86 forms an angle with the axis of the push button whereby a component of the restoring force on the wire 64 forces it to slide on the strip into engagement with the contact 80 as shown.

In accordance with conventional practice, the temperature of the bimetal strip 86 is determined by the magnitude of electrical current passing through it. For this purpose the electrical current which passes through the contacting spring wire 64 is divided between the engaging contact 82 and the bimetal strip which are connected in parallel by circuits external to the switch (not shown). Thus the current through the bimetal strip is less than but proportional to the current passing through the contacts 82.

Figure 12:
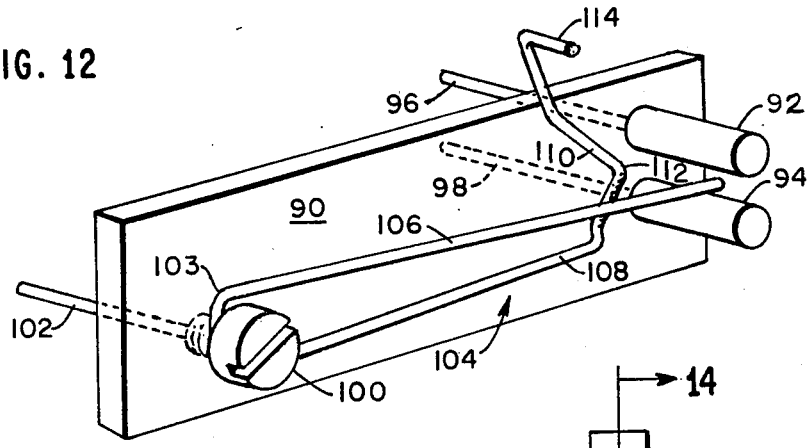
FIGS. 12 to 14 illustrate a fourth embodiment comprising a reduced number of parts and suitable for miniaturization, FIG. 12 being a diagonal view, FIG. 13 being a side elevation and FIG. 14 being an elevation in section taken on line 14—14 of FIG. 13.
Figure 13:
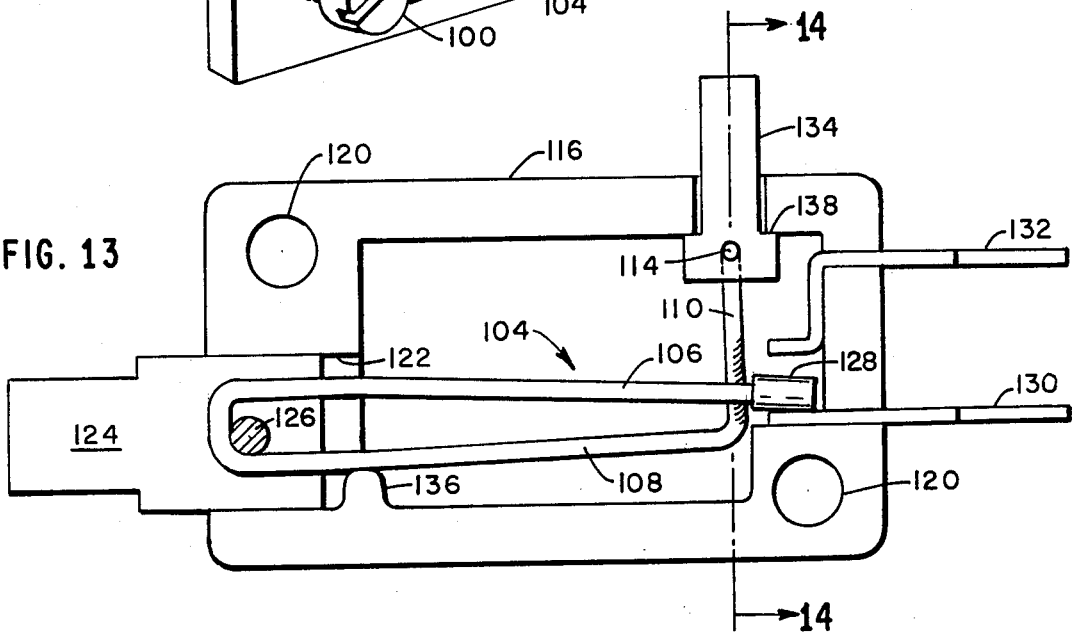
Figure 14:
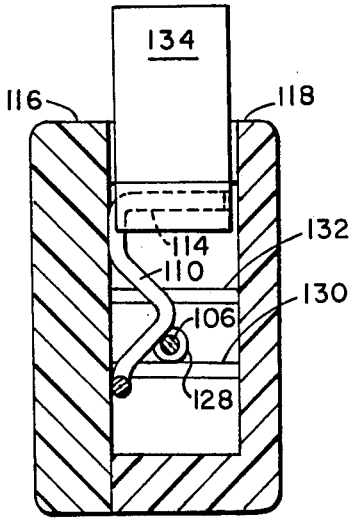

FIGS. 12 to 14 illustrate two forms of the invention, in which the elongate spring member is integral with the actuator, both of which parts are fabricated from a single piece of spring wire. FIG. 12 shows one embodiment having a flat base 90 of insulating material. Electrical contacts 92 and 94 having electrical wire extensions 96 and 98, respectively, for external connection, are mounted in the base 90. A mounting screw 100 also having an electrical contact wire extension 102 is threaded in the base, and passes through the bight 103 in a spring wire 104.

The wire 104 comprises an elongate spring portion 106 and an actuator portion 108. The latter portion is formed into a V-shaped portion 110 having two surfaces intersecting at 112, one of the intersecting portions engaging the spring portion 106 with the latter in engagement with the contact 94. The actuator portion has an end 114 suitably formed so that it may be depressed downwardly as viewed in the drawing to produce the snap action. As in the previously described embodiments, the spring member 106 has a wiping action against the contact 92 or 94 with which it is in engagement as the point of contact with the actuating surfaces approaches the intersection 112. The assembly may be enclosed within a cover, if desired.

The bight 103 is firmly clamped by the screw 100 so that the actuator portion 108 and spring member portion 106 are each functionally cantilever supported at the screw 100 and deflectable independently of the other. The parts are assembled in the relative positions shown in FIG. 12 when no external force is applied to the end portion 114 of the actuator. In this position, the V-shaped portion 110 is urged downwardly as viewed in the drawing, being restrained by the spring member portion 106 which is deflected into engagement with the contact 94. Thus the force on the spring member due to the deflection of the actuator member 108 exceeds the restoring force due to deflection of the spring member 106, the difference being equal to the force of engagement with the contact 94.

Upon the application of an external force to the portion 114 in the downward direction as viewed in the drawing, the spring member portion 106 moves toward the apex 112 of the portion 110 and slides on the surface of the contact 94 with an increasing contact force. Upon passing over the apex 112 the spring member portion 106 snaps into engagement with the contact 92 in a manner similar to that described with reference to the preceding embodiments.

The embodiment of FIG. 12 is suited for such miniaturized applications as switches for use in conjunction with printed circuits and the like. The embodiment of FIGS. 13 and 14 illustrates a variant adaptable for larger switch configurations. This embodiment is mounted within a two-part housing of insulating material comprising a base 116 and a cover 118. The housing is held together by screws (not shown) passing through a pair of holes 120.

The base 116 has a recess 122 for receiving an electrically conducting terminal 124 bearing a projecting pin 126. A wire spring member 104 is received over the pin 126 and is of identical construction to the like-numbered wire member of FIG. 12. In this embodiment a contact sleeve 128 is preferably affixed to the end of the spring portion 106, and engages one or the other of fixed contact blades 130 and 132 corresponding to the contacts 94 and 92 of FIG. 12, respectively. The end portion 114 of the V-shaped portion 110 is received in a hole passing through an insulating push button 134.

The base 116 has an internal rib 136 bearing upon the actuator portion 108 with sufficient force to deflect it to a position in which a shoulder 138 on the push button resiliently bears upon the base 116, as shown, when no external force is applied to the push button. The V-shaped portion 110 deflects the cantilever spring member portion 106 to cause the sleeve portion thereof to bear upon the contact 130. Thus, in this embodiment the normally closed switch position is reached by a predetermined deflection of the actuator portion 108 as determined by the relative locations of the rib 136 and the end portion 114 when assembled into the hole in the push button.

Figure 15:
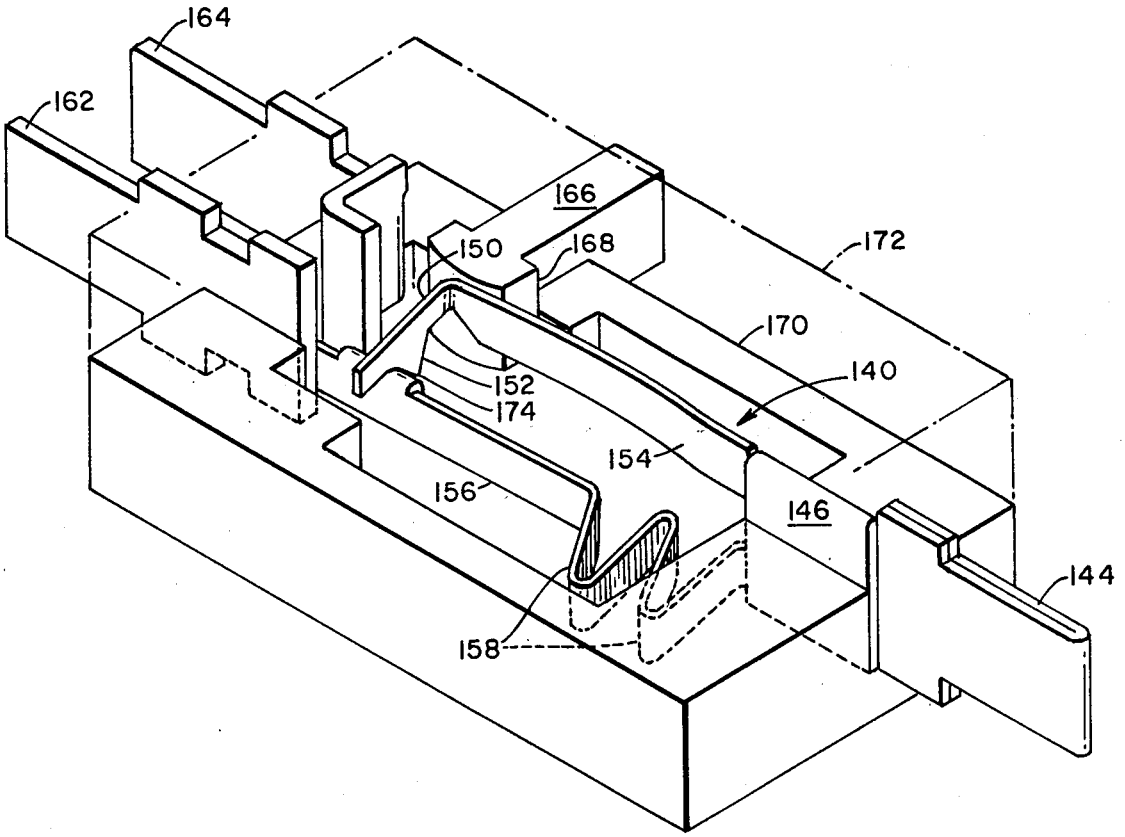
FIGS. 15 to 17 illustrate a fifth embodiment in which the spring member and the actuator are formed from a single folded piece of flat metal, FIG. 15 being a diagonal view, FIG. 16 showing the flat metal piece prior to folding and FIG. 17 being a diagonal view of said piece after folding.
Figure 16:
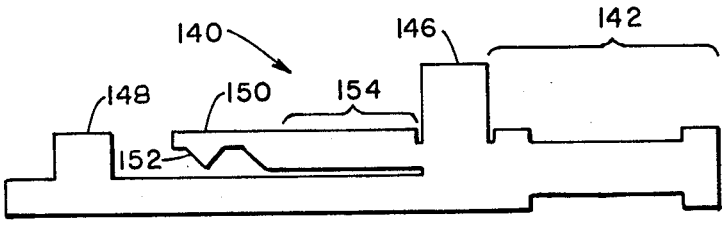
Figure 17:
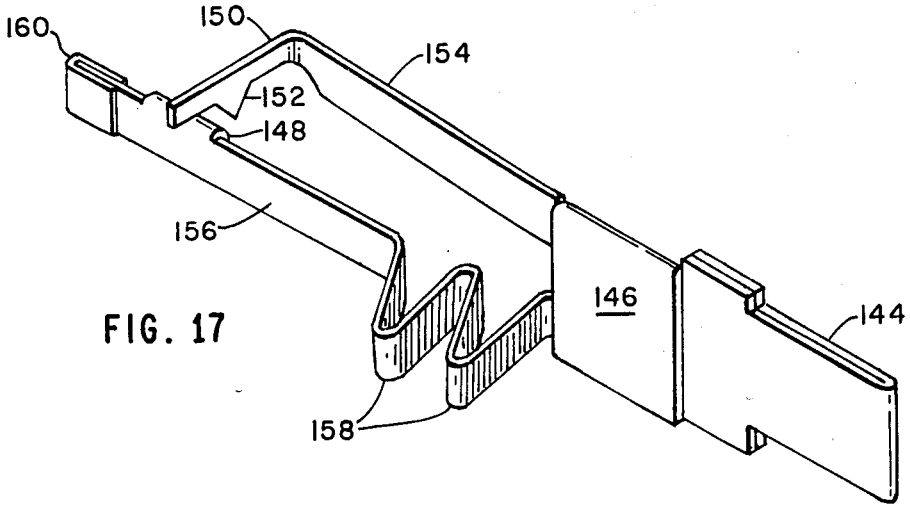

The embodiment of FIGS. 15 and 16 illustrates the use of a folded flat metal strip integrally comprising the spring member and actuator portions. FIG. 16 illustrates a flat spring member 140 as stamped from a flat sheet of metal, prior to folding. A portion 142 is folded upon itself to comprise a terminal 144. Tabs 146 and 148 are folded to form double thicknesses of metal. A portion 150 having a V-shaped projection 152 is folded at right angles to a portion 154 so that the V-shaped portion is engageable with a spring member portion 156 as shown in FIG. 17. The member 156 is deflectable in all directions normal to the lengthwise dimension of the member 156 by reason of a plurality of folds 158 therein. A contact strip 160 may be attached to the end of the spring member 156. This contact strip is in position to engage either of two contact strips 162 and 164. The actuator portion 154 engages a push button 166 having a shoulder 168. The push button is slidable in an aperture in an insulating base member 170 suitably slotted to receive the member 140 and the contacts 162 and 164. An insulating cover 172 shown in broken lines is preferably adapted to fit over the parts, enclosing the same.

In this embodiment the parts are formed so that when no external force is applied to the push button 166, the portion 154 applies a force to the push button resiliently holding the shoulder 168 in engagement with the wall of the base 170, and the V-shaped portion 152 engages the spring member portion 156, deflecting it into engagement with the contact strip 162. When the push button is depressed, the engaging portion of the spring 156 advances towards the apex 174 of the V-shaped portion, and upon passing over the apex, the spring member portion 156 is snapped into engagement with the contact strip 164. Upon the release of the push button, the restoring force of the strip 154 causes a reversal of the above-described movements, with the contact portion 156 again snapping into engagement with the strip 162.

Figure 18:
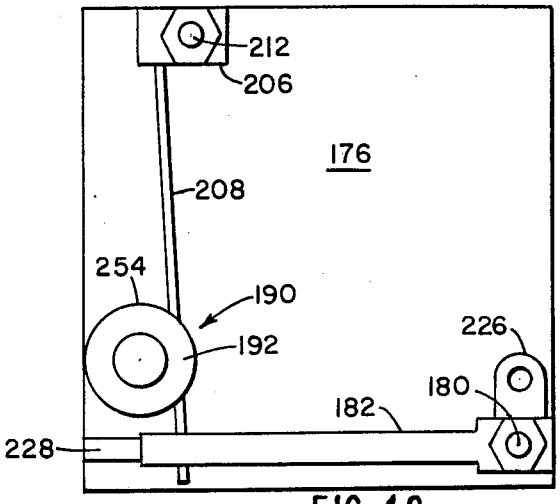
FIGS. 18 to 21 illustrate a sixth embodiment of the invention in which all of the front and back contacts are resiliently mounted, FIG. 18 being a plan view, FIG. 19 being a front elevation, FIG. 20 being a side elevation and FIG. 21 being an illustration depicting the action of the switch.
Figure 20:
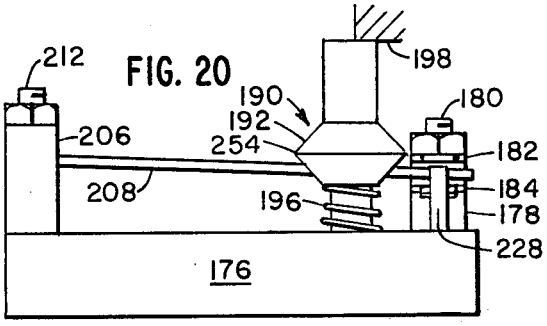
Figure 19:
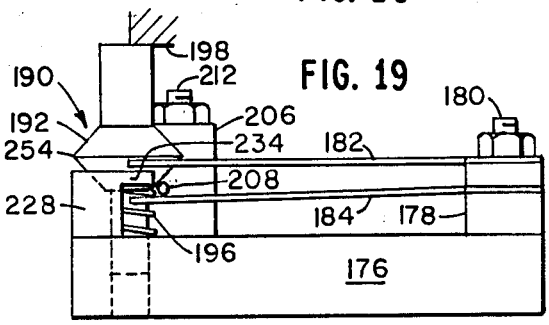

The embodiment of FIGS. 18 to 20 shares many of the features of the above-described embodiments, but differs in that the normally open and normally closed contacts are resiliently cantilever mounted on the base, rather than being fixed in relation to it. The parts are mounted on a rectangular insulating base 176. A contact support 178, also of insulating material, is fastened to the base by a screw 180. Leaf spring contact arms 182 and 184 are respectively clamped in mutually insulating relationship on the member 178, extending in a generally parallel direction.

A cam actuator 190 having a V-shaped spool portion 192 is slidably mounted in a thru hole in the base. A helical compression spring 196 resiliently urges the actuator against an abutment 198 suitably fixed to the base.

A member 206 fixed to the base provides a cantilever support for a spring wire member 208 projecting between the contacts 182 and 184. The spring is clamped to the support 206 by a screw 212.

Suitable terminals such as 226 for connection to an external circuit are separately provided for the front and back contacts 182 and 184 and the movable contact wire 208.

A member 228 is fixed to the base and has a projection 234 between the contacts 182 and 184 which provides limits to the motion of the contacts.

Figure 21:
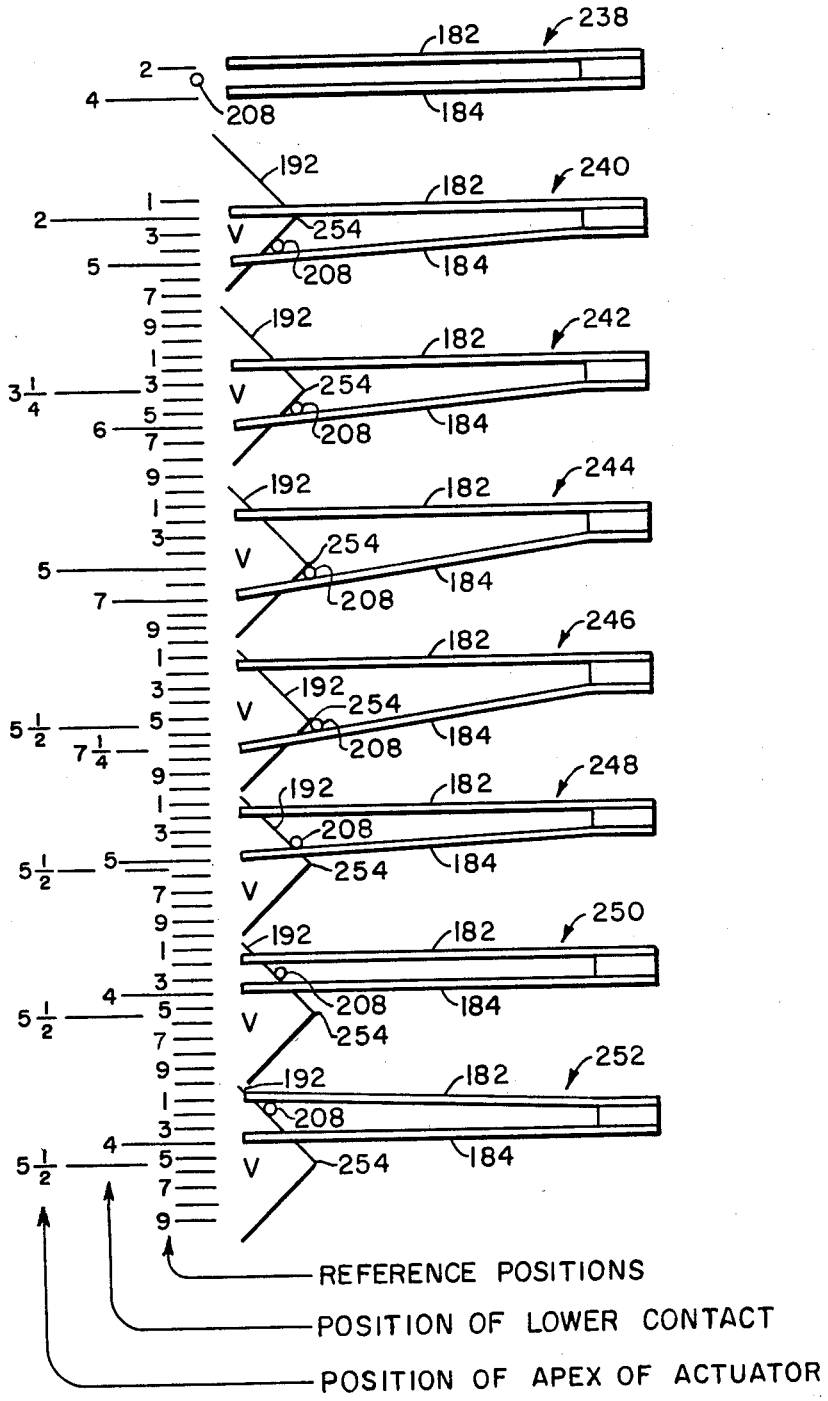

The operation of the embodiment of FIGS. 18 to 20 is illustrated in FIG. 21. At 238 the wire 208 and contact arms 182 and 184 are shown in the relative positions they would assume if unstressed, that is, if the actuator 190 were removed from the apparatus. The scale to the left of the figure permits a determination of the deflection of each of the members from these unstressed positions in a sequence beginning with the actuator spool portion 192 in its uppermost position as shown at 240 in FIG. 21 and in FIGS. 18 to 20, through a series of positions depicted at 242, 244, 246, 248 and 250, and ending with the actuator spool portion in its lowermost position as shown at 252.

In the switch condition depicted at 240 the spring contact 208 is engaged with the normally closed contact arm 184 which is slightly deflected. As the actuator 192 is depressed toward the condition depicted at 242, the spring contact wipes over the contact arm 184, further deflecting it and causing an increase in the contact pressure. The deflection and contact pressure continue to increase as the actuator moves toward the position depicted at 244. The restoring force on the spring contact 208 produced by its deflection from the unstressed position shown at 238 remains in balance with the respectively increasing forces on the contact 208 applied by the actuator 192 and the contact arm 184, respectively. At the position shown at 244, the apex 254 of the actuator has approximately reached the circumference of the spring contact 208, and further downward movement of the actuator will quickly result in the upward force of the contact arm 184 overcoming the downward force on the spring contact 208 and will force the snap action to occur with the contacts passing rapidly through the positions shown at 248 and 250 to the position shown at 252 wherein the spring contact 208 is engaged with the contact arm 182. As the spring contact 208 moves over the apex 254 the contact arm 184 will remain in engagement with it and will accelerate it upwardly toward the contact arm 182, until the contact arm 184 reaches a stop provided by the projection 234 (FIG. 19). At this point the resultant of the restoring force on the deflected spring contact 208 and the force applied to it by the actuator are sufficient to move it into engagement with the contact arm 182.

In the above-described action, this embodiment differs from those previously described, in that when the parts are in the position depicted at 244, substantial contact pressure exists between the spring contact 208 and the contact arm 184 by virtue of the deflection of the latter. This pressure is maintained on the spring contact as it passes over the apex 254 and continues until the position is reached at 248, whereupon the spring contact 208 breaks away from the contact arm 184 and rapidly engages with the normally open contact arm 182. The advantage of this arrangement is that contact pressure on the movable contact 208 is sustained through the snap action.

Figure 22:
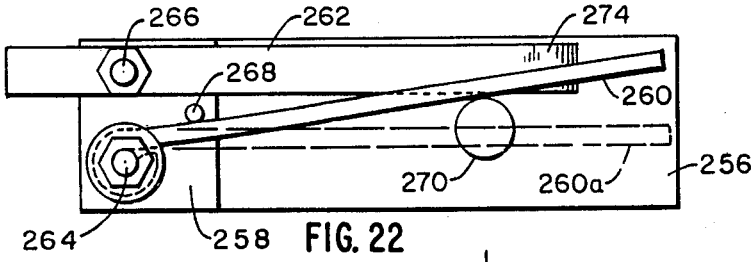
FIGS. 22 to 24 illustrate a seventh embodiment of the invention comprising a thermostatically operated circuit breaker, FIG. 22 being a view in plan, FIG. 23 being a side elevation, and FIG. 24 being a right end elevation.
Figure 23:
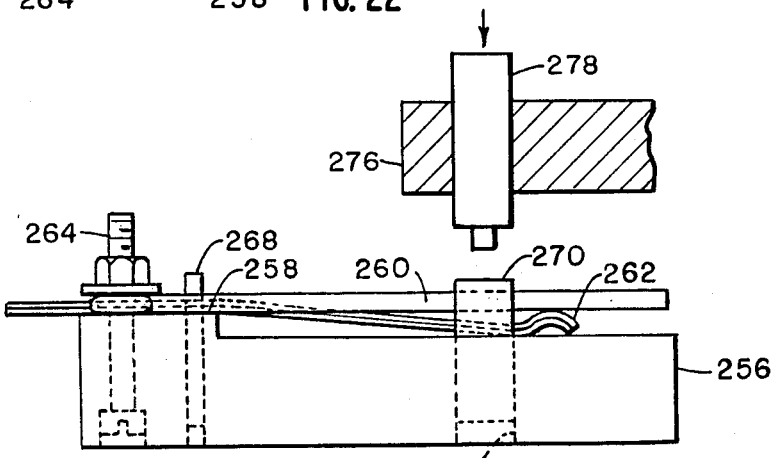
Figure 24:
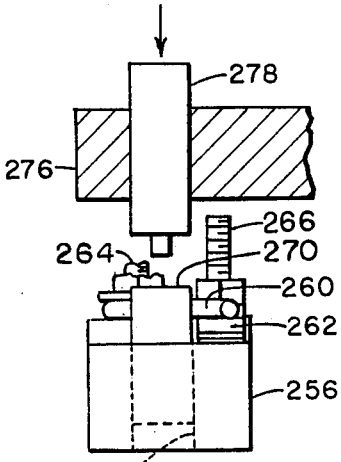

FIGS. 22 to 24 illustrate an embodiment of the invention comprising a thermostatically operated or current overload switch of simplified construction. The actuator is fixed to but adjustably located on the support, in contrast to the above-described embodiments; and its motion relative to the electrically conductive element is produced by movement of the latter in response to an internally applied force, in contrast to an external force as in the push button embodiments. A base 256 is constructed of insulating material and has a platform 258 on which a spring wire contact member 260 and a bimetal electrically conductive strip 262 are respectively cantilever mounted on posts or screws 264 and 266, respectively. A pin 268 projects upwardly from the platform 258 to restrain the wire 260.

An insulating cylindrical actuator plug 270 has a friction fit in a through hole 272 in the base. In this embodiment, the top end surface of the plug is flat and normal to the axis of the plug. The cylindrical surface of the plug and its circular end surface comprise the two surfaces that intersect at the circular circumferential end edge. As shown, the plug engages and deflects the wire 260. The unrestrained position of the wire 260, that is, the position it would assume if the plug were removed from the assembly, is shown in broken lines at 260*a*.

The free end portion of the bimetal strip 262 has a formed end 274 which engages and makes electrical contact with the wire 260 when the latter is deflected by the plug 270 as shown in the drawings. This is the reset or closed position of the switch. External connections (not shown) provide a circuit between the screws 264 and 266. Current passing through this circuit generates heat in the bimetal strip 262 causing the formed end 274 to move upwardly as viewed in FIG. 23. This pushes the wire 260 toward the end of the plug 270, and sufficient movement causes the wire to pass over the intersection of the cylindrical and circular end surfaces and to snap away from the strip 262, thereby opening the circuit. The switch is manually reset by means (not shown) restoring the wire to the deflected position of FIG. 22.

Calibration of this embodiment is preferably carried out in a fixture provided with a support 276 for an adjustably slidable plunger 278. The plunger 278 is brought into engagement with the plug 270, and a source of electrical current is connected between the screws 264 and 266. The current is increased through the wire 260 and strip 262 until the latter is deflected to a position corresponding to the current value at which the circuit is to open. The plunger 278 is then advanced against the plug 270, frictionally sliding it into the hole 272, until the wire 260 snaps away from contact with the strip 262.

In the embodiment of FIGS. 22 to 24, the plug 270 has a friction fit in the base. Alternatively, the plug may be threaded in the base and its lower end as viewed in FIG. 23 may be slotted to receive a screw driver for purposes of adjustment.

From the embodiments of FIGS. 18 to 20 and 22 to 24, it will be evident that the earlier described embodiments, namely those of FIGS. 1 to 5, 6 to 8, 9 to 11, 12 to 14 and 15 to 17, may each be modified by having the front and back contacts mounted on the support so that the portion engaging the movable spring contact is resiliently deflectable. The mounting may be as a cantilever, or alternatively, the front and back contacts may be carried on helical compression springs or the like which are seated in the support. With these modifications, such embodiments would have the same characteristics in operation as the embodiments of FIGS. 18 to 20 and 22 to 24.

The above-described embodiments illustrate the large variety of possible embodiments of the invention, and it will be recognized that various combinations of the features, as well as other obvious structural variations, may be made for the purposes of particular applications, without departing from the spirit or scope of the invention.

We claim:

1. A snap acting switch comprising, in combination, a support, an elongate spring member cantilever mounted at one end on the support, extending in a first direction and having a contact portion spaced from said end and deflectable in second and third directions perpendicular to one another and to said first direction, an electrically conductive element having a contact portion extending in said second direction and being resiliently deflectable in said third direction, and an actuator comprising a leaf spring mounted on the support and having surfaces intersecting at an angle, said actuator and conductive element being arranged to cause an engagement position on one of said surfaces to bear on the spring member with the spring member deflected in said second and third directions and with its contact portion bearing with a contact force on the deflectable contact portion of said conductive element, the actuator and said conductive element being relatively movable in said third direction by an applied force to increase said deflection of the spring member and said contact portion of the conductive element until said engagement position reaches the intersection of said surfaces, whereupon further relative movement permits a force resulting from deflection of the contact portion of the conductive element to accelerate the spring member past said intersection and to snap it away from said conductive element.

2. A switch according to claim 1, in which said intersecting surfaces of the actuator are formed so that its motion relative to said conductive element increases the deflection of said contact portion of the spring member in the second direction, thereby causing it to have wiping contact on said conductive element.

3. A switch according to claim 1, in which the spring member comprises a length of spring wire.

4. A switch according to claim 1, in which the spring member comprises a leaf of sheet form folded to be deflectable in said second and third directions.

5. A switch according to claim 1, in which said contact portions are in rolling contact.

6. A switch according to claim 1, in which the actuator has rolling contact with the spring member.

7. A switch according to claim 1, including a pair of electrically conductive elements having spaced apart contact portions each extending in said second direction and being resiliently deflectable in said third direction, said applied force causing the contact portion of the spring member to snap away from one to the other of said conductive elements.

8. A switch according to claim 7 in which said intersecting surfaces of the actuator are formed so that its motion relative to said conductive elements in each sense of said third direction increases said deflection of the spring member in the second direction, thereby causing the contact portion of the spring member to have wiping contact on said conductive elements.

9. A switch according to claim 8, in which the actuator has surfaces intersecting at a pair of oppositely directed angles, and including a pair of said electrically conductive elements and a pair of said spring members resiliently bearing on opposite sides of the actuator with their contact portions each bearing on one of said conductive elements.

10. A snap acting switch comprising, in combination, a support, an element formed of spring material having a portion fixed to the support and integral spring and actuator portions each extending therefrom, the spring portion being elongate and cantilever mounted at said fixed portion, extending in a first direction therefrom and having a contact portion spaced from said fixed portion and deflectable in second and third directions perpendicular to one another and to said first direction, and an electrically conductive element having a surface extending in said second direction, said actuator portion having surfaces intersecting at an angle and being arranged relative to the conductive element to cause an engagement position on one of said surfaces to bear on said spring portion to deflect it in said second and third directions and with the contact portion bearing with a contact force on said conductive element, the actuator portion and said conductive element being relatively movable in said third direction by an applied force to increase said deflection and contact force as said engagement position approaches the intersection of said surfaces, said angle being arranged to cause said contact portion to snap away from said conductive element when the engagement position passes over said intersection.

11. A switch according to claim 10, in which said element of spring material comprises a length of spring wire.

12. A switch according to claim 10, in which said element of spring material comprises a leaf of sheet form folded to be deflectable in said second and third directions.

* * * * *